US009948000B2

(12) United States Patent
Hu

(10) Patent No.: US 9,948,000 B2
(45) Date of Patent: Apr. 17, 2018

(54) ANTENNA MODULE

(71) Applicant: PEGATRON CORPORATION, Taipei (TW)

(72) Inventor: Shao-Kang Hu, Taipei (TW)

(73) Assignee: Pegatron Corporation, Taipei (TW)

( * ) Notice: Subject to any disclaimer, the term of this patent is extended or adjusted under 35 U.S.C. 154(b) by 94 days.

(21) Appl. No.: 15/157,763

(22) Filed: May 18, 2016

(65) Prior Publication Data

US 2016/0372827 A1 Dec. 22, 2016

(30) Foreign Application Priority Data

Jun. 18, 2015 (TW) ..... 104119830 A

(51) Int. Cl.
*H01Q 1/38* (2006.01)
*H01Q 9/04* (2006.01)
*H01Q 1/00* (2006.01)

(52) U.S. Cl.
CPC ..... *H01Q 1/38* (2013.01); *H01Q 1/002* (2013.01); *H01Q 9/0407* (2013.01)

(58) Field of Classification Search
CPC ..... H01Q 1/38; H01Q 1/002; H01Q 9/0407; H01Q 1/50; H01Q 9/04
USPC ..... 343/700 MS, 846
See application file for complete search history.

(56) References Cited

U.S. PATENT DOCUMENTS

| | | | | |
|---|---|---|---|---|
| 5,382,959 | A * | 1/1995 | Pett | H01Q 21/065 343/700 MS |
| 7,623,087 | B2 * | 11/2009 | Higaki | H01Q 1/243 343/702 |
| 7,911,386 | B1 * | 3/2011 | Itoh | H01Q 9/0407 343/700 MS |
| 8,406,825 | B2 | 3/2013 | Huang et al. | |
| 8,446,324 | B2 * | 5/2013 | Yukimoto | H01Q 1/3241 343/700 MS |
| 2007/0085742 | A1 * | 4/2007 | Kikin | H01Q 9/30 343/700 MS |
| 2008/0122712 | A1 * | 5/2008 | Chen | H01Q 9/0471 343/745 |
| 2012/0329524 | A1 | 12/2012 | Kent et al. | |

FOREIGN PATENT DOCUMENTS

| | | |
|---|---|---|
| CN | 102017339 | 4/2011 |
| TW | M314427 | 6/2007 |
| TW | M460421 U1 | 8/2013 |
| TW | 201419657 | 5/2014 |
| TW | M498437 | 4/2015 |

* cited by examiner

*Primary Examiner* — Dameon E Levi
*Assistant Examiner* — Hasan Islam
(74) *Attorney, Agent, or Firm* — Muncy, Geissler, Olds & Lowe, P.C.

(57) ABSTRACT

An antenna module includes a radiation unit, a ground unit and an electrostatic protection unit. The radiation unit includes a metal element and a substrate. The metal element is disposed on a surface of the substrate. The ground unit is disposed on another surface of the substrate. The electrostatic protection unit is disposed in the substrate and connected between the metal element and the ground unit.

9 Claims, 3 Drawing Sheets

ANTENNA MODULE

CROSS REFERENCE TO RELATED APPLICATIONS

This Non-provisional application claims priority under 35 U.S.C. § 119(a) on Patent Application No(s). 104119830 filed in Taiwan, Republic of China on Jun. 18, 2015, the entire contents of which are hereby incorporated by reference.

BACKGROUND

Technical Field

This invention relates to an antenna module and, in particular, to an antenna module which can protect the communication component from being damaged by the static electricity and also can meet the standard requirement of the electrostatic protection test, and further, can provide better communication quality for the electronic device.

Related Art

Portable electronic devices have gradually attracted most consumers in recent years due to their advantages such as compact size, convenient operation experience and powerful functions. Meanwhile, portable electronic devices are also continuously developed towards the lightness and thinness. Presently, most portable electronic devices are equipped with a wireless transmission function, and the antenna used therein is one of the main components for the wireless transmission function.

However, in the process of the manufacturing, production, assembly, test, storage or transportation of the electronic device, some static electricity will be accumulated on the human body, instrument or storage equipment or even on the electronic components themselves. If the above-mentioned objects contact each other in an unintended situation, the electricity discharging path will be formed, and therefore the electronic device or components will be influenced by the electrostatic discharge (ESD). As a result, not only the components will be damaged, but also the communication quality will be reduced.

In the prior art, for the electronic device with the wireless communication function, the antenna module will be disposed inside the systematic structure (such as a casing), to avoid that the electrostatic energy is directly coupled to the radiation portion of the antenna module causing the damage of the rear-end communication component. Otherwise, a part of the ground area is formed in the antenna module to avoid the electrostatic energy from being directly coupled to the radiation portion of the antenna module and from flowing in through the feed point to damage the rear-end radio-frequency module. However, the above two methods will both reduce the sensitivity of the antenna module for a certain level.

Although the above methods can avoid the electrostatic energy from being directly coupled to the antenna module and can thus protect the communication component from the influence of the static electricity, it still does not meet the standard requirement of the electrostatic protection test for the precision electronic device. Besides, the sensitivity of the antenna module for receiving signals will be deteriorated for a certain level, and therefore the electronic device will be kept in a state with worse communication quality.

Therefore, it is an important subject to provide an antenna module which can protect the communication component from being damaged by the static electricity and also can meet the standard requirement of the electrostatic protection test, and further, can provide better communication quality for the electronic device.

SUMMARY

An aspect of the disclosure is to provide an antenna module which can protect the communication component from being damaged by the static electricity and also can meet the standard requirement of the electrostatic protection test, and further, can provide better communication quality for the electronic device.

An antenna module according to the disclosure includes a radiation unit, a ground unit and an electrostatic protection unit. The radiation unit includes a metal element and a substrate. The metal element is disposed on a surface of the substrate. The ground unit is disposed on another surface of the substrate. The electrostatic protection unit is disposed in the substrate and connected between the metal element and the ground unit.

In one embodiment, the antenna module further comprises an electrical conduction element disposed in the substrate. The electrical conduction element and the electrostatic protection unit form a series connection between the metal element and the ground unit.

In one embodiment, the electrical conduction element is connected with the ground unit and the electrostatic protection unit is connected with the metal element.

In one embodiment, the electrical conduction element is connected with the metal element and the electrostatic protection unit is connected with the ground unit.

In one embodiment, the electrostatic protection unit and the electrical conduction element are disposed in an area formed by a projection of the metal element on the substrate.

In one embodiment, the electrostatic protection unit and the electrical conduction element are embedded in the substrate.

In one embodiment, the material of the electrical conduction element includes copper, silver, aluminum, zinc, gold or any alloy thereof.

In one embodiment, the electrostatic protection unit is a voltage dependent resistor.

In one embodiment, the material of the electrostatic protection unit includes zinc oxide, silicon carbide, titanium oxide, strontium titanate or any combination thereof.

In one embodiment, the electrostatic protection unit is a surge absorber.

Summarily, in the antenna module, the electrostatic protection unit is disposed between the metal element of the radiation and the ground unit disposed on the substrate, and that is, the electrostatic protection unit is disposed in the substrate. Thereby, the electrostatic energy can be prevented from directly flowing in through the feed point of the radiation unit, so that the damage of the rear-end radio-frequency module can be avoided and the antenna module can be protected. Furthermore, the standard requirement of the electrostatic protection test can be met. Besides, by the electrical conduction element connected with the electrostatic protection unit, the resistance effect generated between the metal element of the radiation unit and the ground unit can be reduced and the bandwidth of the antenna can be decreased, so that the electronic device can be kept with better communication quality. Moreover, the electrostatic protection unit and the electrical conduction element can be disposed anywhere in the substrate for the circuit design, so the freedom of the circuit design can be increased, and further, the antenna module can have various positions in the electronic device according to different communication requirements.

BRIEF DESCRIPTION OF THE DRAWINGS

The embodiments will become more fully understood from the detailed description and accompanying drawings, which are given for illustration only, and thus are not limitative of the present invention, and wherein.

DETAILED DESCRIPTION

The embodiments will be apparent from the following detailed description, which proceeds with reference to the accompanying drawings, wherein the same references relate to the same elements.

Figure 1A:
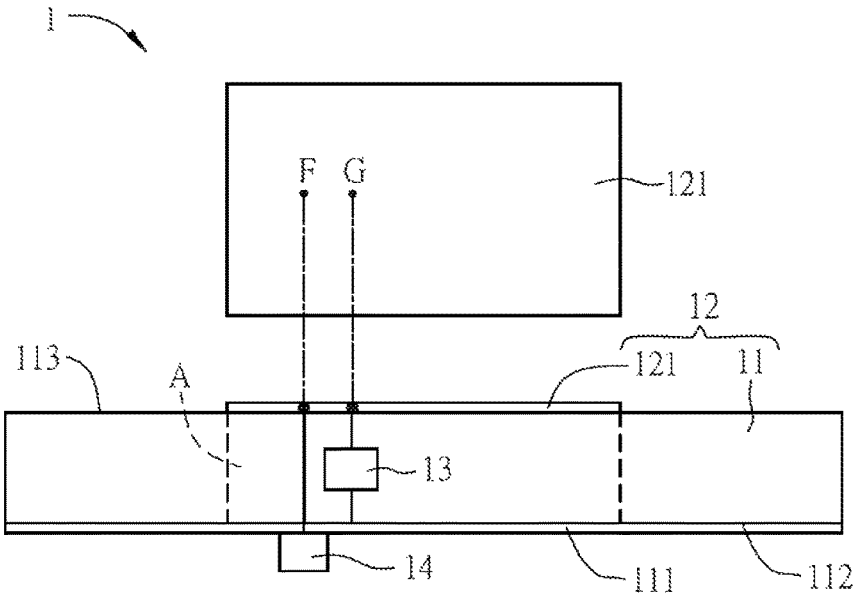
FIG. 1A is a schematic diagram of the antenna module of an embodiment.

FIG. 1A is a schematic diagram of the antenna module of an embodiment. As shown in FIG. 1A, the antenna module 1 includes a ground unit 111, a radiation unit 12 and an electrostatic protection unit 13. The radiation unit 12 includes a metal element 121 and a substrate 11. The ground unit 111 is disposed on a surface 112 of the substrate 11. The metal element 121 of the radiation unit 12 is disposed on another surface 113 which is opposite to the surface 112. The electrostatic protection unit 13 is disposed in the substrate 11 and connected between the metal element 121 and the ground unit 111.

In this embodiment, the electrostatic protection unit 13 is for example but not limited to a voltage dependent resistor. In other embodiments, different elements, such as a surge absorber, can be selected corresponding to what kind of the electronic device which the antenna module 1 is applied to. The voltage dependent resistor is just used for the illustrative purpose in this embodiment. Moreover, the substrate 11 is for example but not limited to a glass substrate. The substrate can be, for example, a PVC (polyvinyl chloride) substrate, a PET (polyethylene terephthalate) substrate, a PC (polycarbonate) substrate, an ABS (acrylonitrile butadiene styrene) substrate or a PETG (polyethylene terephthalate) substrate. Besides, the material of the electrostatic protection unit 13 includes zinc oxide, silicon carbide, titanium oxide, strontium titanate or any combination thereof.

According to the above-mentioned composition, when the human body contacts the electronic device or the electrostatic discharge between the elements occurs, a short circuit state will be formed between the metal element 121 and the ground unit 111 because the impedance of the electrostatic protection unit 13 is lower, so that the instant electrostatic energy can be short-circuited through the path formed among the metal element 121, the electrostatic protection unit 13 and the ground unit 111 so as to be transmitted to the ground unit 111 disposed on the substrate 11 from the electrostatic protection node G on the radiation unit 12 and then flow out. Therefore, the electrostatic energy will not directly flow to the feed point F on the radiation unit 12 and also won't enter into the feeding element 14, which can prevent the radio-frequency module (not shown) of the rear stage of the antenna module 1 from being damaged.

In more detail, when the electrostatic protection unit 13 (e.g. a voltage dependent resistor) is at a preparation state, the impedance of the electrostatic protection unit 13 is an enormous value (several million ohms) relative to the feed point F of the radiation unit 12. However, when the instant surge voltage occurs, i.e. the electrostatic discharge (ESD) occurs, the ESD will exceed the breakdown voltage of the voltage dependent resistor, so that the impedance of the voltage dependent resistor will be lowered down (to several ohms) and a short circuit will be thus formed. Consequently, the instant ESD will be transmitted to the ground unit 111 through the short circuit formed by the voltage dependent resistor from the electrostatic protection node G on the radiation unit 12 and then flow out, so as to prevent the ESD from directly flowing into the feeding element 14 through the feed point F and thus to avoid the radio-frequency module of the rear stage of the antenna module 1 from being damaged. By the above-mentioned composition, not only the antenna module 1 can be made more effectively in dealing with the ESD generated due to the external environment influence so that the standard requirement of the electrostatic protection test required by the precision electronic device can be satisfied, but also the problem of that the ESD interferes with the signal transmission of the radiation unit 12 after flowing into the feed point F can be solved so that the communication quality can be improved.

Figure 1B:
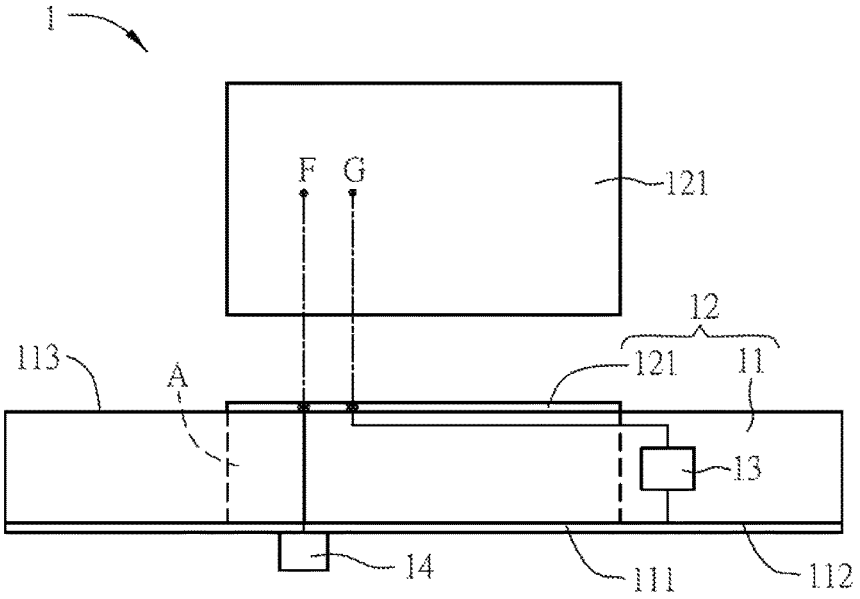
FIG. 1B is a schematic diagram of a variation of the antenna module of an embodiment.

To be noted, in FIG. 1A, the electrostatic protection unit 13 is disposed, for example, in the area A formed by the projection of the metal element 121 on the substrate 11. However, it is not limited thereto. The position of the electrostatic protection unit 13 can be varied according to the circuit design or arrangement of the antenna module 1. For example, as shown in FIG. 1B, which is a schematic diagram of a variation of the antenna module of an embodiment, the electrostatic protection unit 13 can be disposed outside the area A formed by the projection of the metal element 121 on the substrate 11. Such disposition of the said position also can make the electrostatic protection unit 13 function to protect the radiation unit 12 and can increase the freedom of the circuit design, and further, can add variety of the position of the antenna module 1 in the electronic device according to different communication requirements.

Figure 2A:
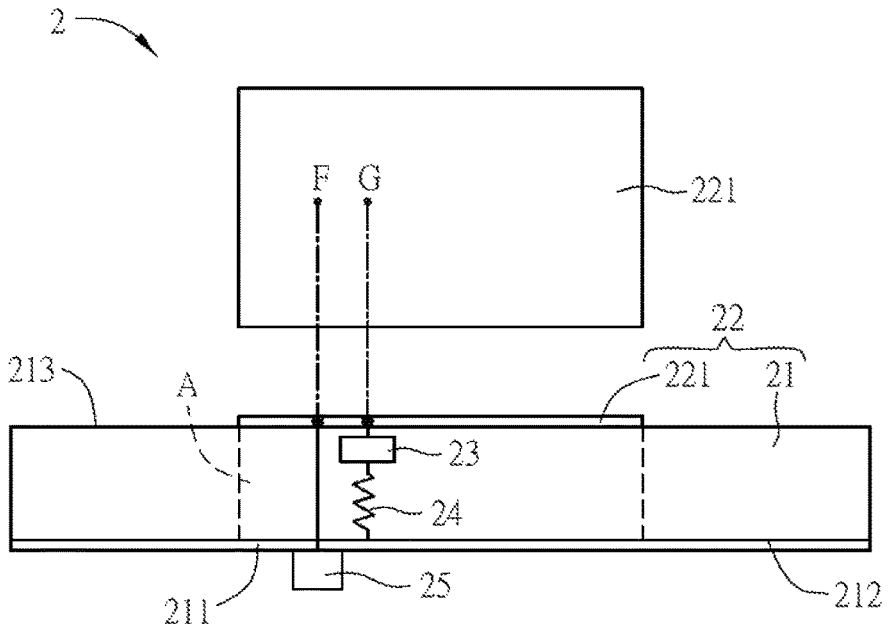
FIG. 2A is a schematic diagram of the antenna module of another embodiment.

FIG. 2A is a schematic diagram of the antenna module of another embodiment. In FIG. 2A, in addition to a ground unit 211, a radiation unit 22 and an electrostatic protection unit 23, the antenna module 2 further includes an electrical conduction element 24. Since the relationship of the disposition among the metal element 221, the ground unit 211, the substrate 21 and the feeding element 25 is the same as the cases of FIGS. 1A and 1B, the related illustrations are omitted here for conciseness, and the following illustration is mainly for the electrical conduction element 24. The electrical conduction element 24 is disposed in the substrate 21, and the electrical conduction element 24 and the electrostatic protection unit 23 form a series connection between the metal element 221 of the radiation unit 22 and the ground unit 211 of the substrate 21. Furthermore, one end of the electrostatic protection unit 23 is connected with the metal element 221 of the radiation unit 22, and the other end of the electrostatic protection unit 23 is connected with the electrical conduction element 24. The other end of the electrical conduction element 24 not connected with the electrostatic protection unit 23 is connected with the ground unit 211 disposed on the substrate 21, and the electrostatic protection unit 23 and the electrical conduction element 24 are embedded in the substrate 21.

The principle used in which the electrostatic protection unit 23 prevents the static electricity from directly flowing into the feed point F is the same as that used in the embodiments of FIGS. 1A and 1B, so the related illustration is omitted here for conciseness. The main difference between them is illustrated as below. After the electrostatic protection unit 23 is disposed in the substrate 21, the characteristic of the high impedance of the electrostatic protection unit 23 at the preparation state is equivalent to the additional existence of the resistance effect between the metal element 221 of the radiation unit 22 and the ground unit 211, wherein the resistance effect will increase the bandwidth of the antenna. The resistance effect can be counteracted by the disposition of the electrical conduction element 24, and therefore the communication quality of the electronic device can be further improved.

Figure 2B:
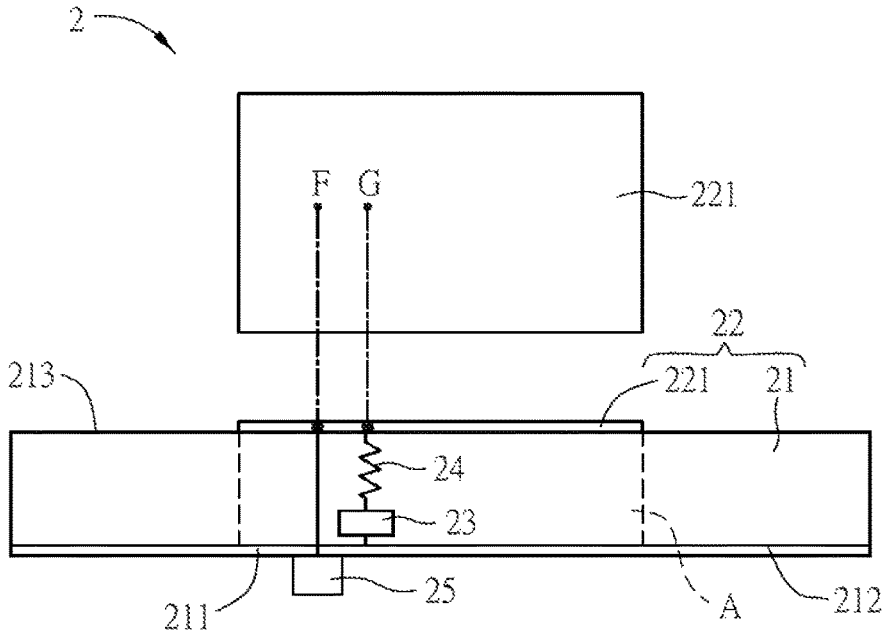
FIGS. 2B to 2D are schematic diagrams of the variations of the antenna module of an embodiment.
Figure 2C:
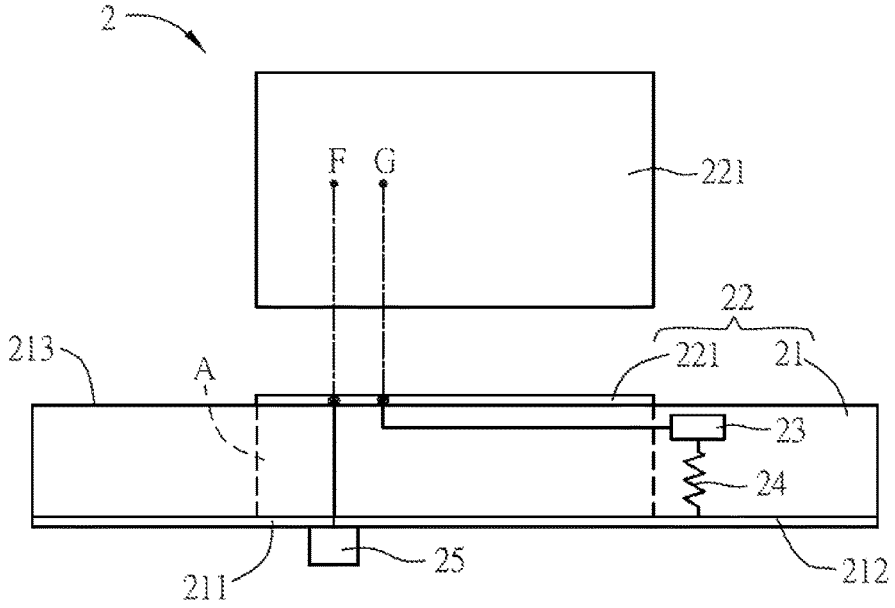
Figure 2D:
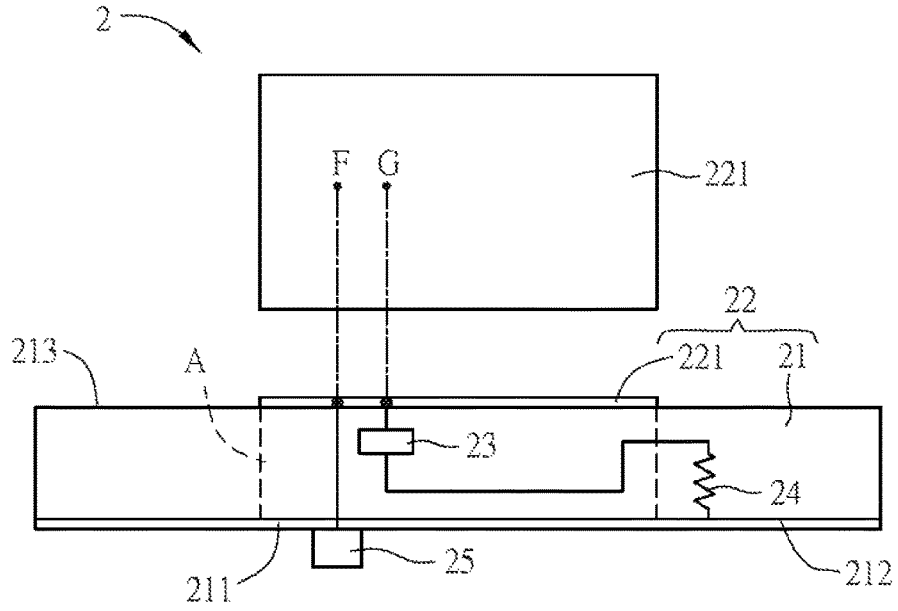

In the embodiment of FIG. 2A, for example, the electrical conduction element 24 is connected with the ground unit 211 and the electrostatic protection unit 23 is connected with the metal element 221, and the electrostatic protection unit 23 and the electrical conduction element 24 are disposed in the area A formed by the projection of the metal element 221 on the substrate 21. However, they are not limited thereto. FIGS. 2B to 2D are schematic diagrams of the variations of the antenna module of an embodiment. In FIG. 2B, the electrical conduction element 24 is connected with the metal element 221 and the electrostatic protection unit 23 is connected with the ground unit 211. In detail, one end of the electrical conduction element 24 is connected with the metal element 221 of the radiation unit 22 and the other end of the electrical conduction element 24 is connected with the electrostatic protection unit 23, and the other end of the electrostatic protection unit 23 not connected with the electrical conduction element 24 is connected with the ground unit 211 of the substrate 21. In FIG. 2C, the electrostatic protection unit 23 and the electrical conduction element 24 can be disposed outside the area A formed by the projection of the metal element 221 on the substrate 21. In FIG. 2D, the electrostatic protection unit 23 is disposed in the area A and the electrical conduction element 24 is disposed outside the area A. No matter what kind of the disposition is in FIGS. 2A to 2D, the electrostatic protection unit 23 and the electrical conduction element 24 can exhibit their functions. Likewise, the embodiment of the disposition of the electrical conduction element 24 and the electrostatic protection unit 23 in FIG. 2B may be changed into the embodiment of FIG. 2C or 2D.

Accordingly, as long as the electrostatic protection unit 23 and the electrical conduction element 24 are embedded in the substrate 21, the order of the electrostatic protection unit 23 and the electrical conduction element 24 in their series connection can be changed. Besides, the electrostatic protection unit 23 and the electrical conduction element 24 can be both embedded in the area A or outside the area A, or one of them is embedded in the area A while the other one is embedded outside the area A. In other words, the order, the position or the disposition of the electrostatic protection unit 23 and the electrical conduction element 24 will not affect their functions, and all the variations are included in the scope of this disclosure. Through the variations of FIGS. 2B to 2D, the freedom of the circuit design can be increased, and further, the antenna module can have various positions in the electronic device according to different communication requirements.

In this embodiment, the electrostatic protection unit 23 and the electrical conduction element 24 form a series connection embedded in the substrate 21. For effectively counteracting the resistance effect of the electrostatic protection unit 23 and considering the high impedance of the electrostatic protection unit 23, the electrical conduction element 24 needs to be formed by the material with higher electric conductivity, such as copper, silver, aluminum, zinc, gold or any alloy thereof. In this embodiment, copper is used as the material of the electrical conduction element 24. However, it is not limited thereto. Other material can be used in consideration of the manufacturing cost of the antenna module or the electronic device, so as to save the manufacturing cost of the antenna module.

Summarily, in the antenna module, the electrostatic protection unit is disposed between the metal element of the radiation and the ground unit disposed on the substrate, and that is, the electrostatic protection unit is disposed in the substrate. Thereby, the electrostatic energy can be prevented from directly flowing in through the feed point of the radiation unit, so that the damage of the rear-end radio-frequency module can be avoided and the antenna module can be protected. Furthermore, the standard requirement of the electrostatic protection test can be met. Besides, by the electrical conduction element connected with the electrostatic protection unit, the resistance effect generated between the metal element of the radiation unit and the ground unit can be reduced and the bandwidth of the antenna can be decreased, so that the electronic device can be kept with better communication quality. Moreover, the electrostatic protection unit and the electrical conduction element can be disposed anywhere in the substrate for the circuit design, so the freedom of the circuit design can be increased, and further, the antenna module can have various positions in the electronic device according to different communication requirements.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An antenna module, comprising:

a radiation unit including a metal element and a substrate, wherein the metal element is disposed on a surface of the substrate;

a ground unit disposed on another surface of the substrate;

an electrostatic protection unit disposed in the substrate and connected between the metal element and the ground unit; and an electrical conduction element disposed in the substrate, wherein the electrical conduction element and the electrostatic protection unit form a series connection between the metal element and the ground unit.

2. The antenna module recited in claim 1, wherein the electrical conduction element is connected with the ground unit and the electrostatic protection unit is connected with the metal element.

3. The antenna module recited in claim 1, wherein the electrical conduction element is connected with the metal element and the electrostatic protection unit is connected with the ground unit.

4. The antenna module recited in claim 1, wherein the electrostatic protection unit and the electrical conduction element are disposed in an area formed by a projection of the metal element on the substrate.

5. The antenna module recited in claim 1, wherein the electrostatic protection unit and the electrical conduction element are embedded in the substrate.

6. The antenna module recited in claim 1, wherein the material of the electrical conduction element includes copper, silver, aluminum, zinc, gold or any alloy thereof.

7. The antenna module recited in claim 1, wherein the electrostatic protection unit is a voltage dependent resistor.

8. The antenna module recited in claim 1, wherein the material of the electrostatic protection unit includes zinc oxide, silicon carbide, titanium oxide, strontium titanate or any combination thereof.

9. The antenna module recited in claim 1, wherein the electrostatic protection unit is a surge absorber.

* * * * *